US011815037B2

(12) United States Patent
Buchwitz et al.

(10) Patent No.: US 11,815,037 B2
(45) Date of Patent: Nov. 14, 2023

(54) METHOD AND SYSTEM FOR CONTROLLING A TWO STROKE ENGINE BASED ON FUEL PRESSURE

(71) Applicant: Polaris Industries Inc., Medina, MN (US)

(72) Inventors: James H. Buchwitz, Roseau, MN (US); Lucas R. Salfer, Salol, MN (US); G. Jay McKoskey, Forest Lake, MN (US); Jacob Hanson, Fridley, MN (US); Ron Danielson, Roseau, MN (US); Andreas H. Bilek, Chisago City, MN (US); Dallas J. Blake, Roseau, MN (US); Ralph W. Lauzze, III, Hugo, MN (US); Eric L. Gausen, Warroad, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 17/870,028

(22) Filed: Jul. 21, 2022

(65) Prior Publication Data

US 2022/0356850 A1 Nov. 10, 2022

Related U.S. Application Data

(62) Division of application No. 16/696,198, filed on Nov. 26, 2019, now abandoned.

(Continued)

(51) Int. Cl.

*F02D 19/02* (2006.01)
*F02M 59/20* (2006.01)

(Continued)

(52) U.S. Cl.

CPC ..... *F02D 19/028* (2013.01); *F02B 75/02* (2013.01); *F02D 31/007* (2013.01); *F02M 59/20* (2013.01);

(Continued)

(58) Field of Classification Search

CPC ..... F02D 19/028; F02D 31/007; F02D 2200/0625; F02B 75/02; F02B 2075/025; F02M 59/20

(Continued)

(56) References Cited

U.S. PATENT DOCUMENTS 1,656,629 A 1/1928 Gray
1,874,326 A 8/1932 Mason (Continued)

FOREIGN PATENT DOCUMENTS

CN 207648298 U 7/2018
CN 110195644 A 9/2019

(Continued)

OTHER PUBLICATIONS

"Garrett by Honeywell", 2016, Honeywell, vol. 6 (Year: 2016).

(Continued)

*Primary Examiner* — Logan M Kraft
*Assistant Examiner* — John D Bailey
(74) *Attorney, Agent, or Firm* — Harness, Dickey & Pierce, P.L.C.

(57) ABSTRACT

A method and system for operating a two-stroke engine includes a fuel system comprising a fuel pressure sensor, fuel temperature sensor and a fuel injector and a controller in communication with the fuel pressure sensor and fuel temperature sensor. The controller controls the fuel injector with a fuel pulsewidth determined by determining a beginning time of a window for measuring fuel pressure, determining an ending time of the window, measuring fuel (Continued)

pressure between the beginning time and the ending time, determining a fuel pulsewidth based on the fuel pressure and fuel temperature and injecting fuel into the two-stroke engine in response to a desired fuel mass.

11 Claims, 11 Drawing Sheets

Related U.S. Application Data

(60) Provisional application No. 62/776,579, filed on Dec. 7, 2018.

(51) Int. Cl.
*F02B 75/02* (2006.01)
*F02D 31/00* (2006.01)

(52) U.S. Cl.
CPC ..... *F02B 2075/025* (2013.01); *F02D 2200/0625* (2013.01)

(58) Field of Classification Search
USPC ..... 123/457
See application file for complete search history.

(56) References Cited

U.S. PATENT DOCUMENTS 2,047,443 A 7/1936 Starkweather
3,045,419 A 7/1962 Addie et al.
3,190,271 A * 6/1965 Gudmundsen ..... F02M 69/08 123/73 B
3,614,259 A 10/1971 Neff
3,653,212 A 4/1972 Gast et al.
3,703,937 A 11/1972 Tenney
3,868,822 A 3/1975 Keller
3,870,115 A 3/1975 Hase
4,005,579 A 2/1977 Lloyd
4,047,507 A * 9/1977 Noguchi ..... F02D 31/001 123/360
4,169,354 A 10/1979 Woollenweber
4,235,484 A 11/1980 Owen et al.
4,254,625 A 3/1981 Bergstedt et al.
4,289,094 A 9/1981 Tanahashi
4,305,351 A * 12/1981 Staerzl ..... F02D 41/345 123/54.6
4,349,000 A * 9/1982 Staerzl ..... F02B 75/22 123/491
4,468,928 A 9/1984 Suzuki
4,512,152 A 4/1985 Asaba
4,598,549 A 7/1986 Kanawyer
4,628,877 A 12/1986 Sundles et al.
5,050,559 A * 9/1991 Kurosu ..... F02D 41/064 123/73 A
5,051,909 A 9/1991 Gomez et al.
5,085,193 A * 2/1992 Morikawa ..... F02D 41/345 123/497
5,121,604 A 6/1992 Berger et al.
5,191,531 A * 3/1993 Kurosu ..... F02D 41/34 123/295
5,197,426 A 3/1993 Frangesch et al.
5,214,919 A 6/1993 Jiewertz et al.
5,427,083 A 6/1995 Ahern
5,441,030 A * 8/1995 Satsukawa ..... F02D 41/061 123/73 A
5,579,740 A * 12/1996 Cotton ..... F02M 37/0052 123/514
5,586,524 A * 12/1996 Nonaka ..... F02D 35/023 123/73 A
5,630,395 A 5/1997 Katoh et al.
5,726,397 A 3/1998 Mukai et al.
5,782,214 A 7/1998 Nanami et al.
5,791,304 A * 8/1998 Taipale ..... F02M 69/045 123/299
5,813,374 A * 9/1998 Chasteen ..... F02D 37/02 123/73 C
5,832,901 A * 11/1998 Yoshida ..... F02D 41/345 123/480
6,073,447 A 6/2000 Kawakami et al.
6,158,214 A 12/2000 Kempka et al.
6,161,384 A 12/2000 Reinbold et al.
6,162,028 A * 12/2000 Rembold ..... F04B 17/042 123/73 AD
6,170,463 B1 * 1/2001 Koerner ..... F02D 37/02 123/406.47
6,209,530 B1 4/2001 Faletti et al.
6,435,169 B1 8/2002 Vogt
6,443,123 B1 * 9/2002 Aoki ..... F02D 41/38 123/305
6,658,849 B1 12/2003 Hallman et al.
6,739,579 B1 5/2004 Rim
6,745,568 B1 6/2004 Squires
6,830,121 B1 12/2004 Johnson
6,942,052 B1 9/2005 Blakely
6,976,359 B2 12/2005 Hastings et al.
6,983,596 B2 1/2006 Frankenstein et al.
7,017,706 B2 3/2006 Brown et al.
7,621,127 B2 11/2009 Robinson
7,794,213 B2 9/2010 Gaude et al.
8,128,356 B2 3/2012 Higashimori
8,220,262 B2 7/2012 Robinson
8,474,789 B2 7/2013 Shimada et al.
8,483,932 B2 7/2013 Pursifull
8,490,605 B2 7/2013 Gracner et al.
8,528,327 B2 9/2013 Bucknell et al.
8,641,363 B2 2/2014 Love et al.
8,671,683 B2 3/2014 Lilly
9,188,048 B2 11/2015 Bedard
9,322,323 B2 4/2016 Panciroli
9,630,611 B1 4/2017 Dufford
9,670,833 B2 6/2017 Klipfel et al.
9,719,469 B1 8/2017 Pelfrey et al.
10,989,124 B2 4/2021 Yamaguchi et al.
11,131,235 B2 9/2021 Buchwitz et al.
11,255,231 B2 2/2022 Fuhrman et al.
2001/0023683 A1 * 9/2001 Nakamura ..... F02D 41/3082 123/457
2001/0032601 A1 * 10/2001 Galka ..... F02M 17/04 123/73 A
2001/0047656 A1 12/2001 Maddock et al.
2002/0078934 A1 6/2002 Hohkita et al.
2002/0124817 A1 * 9/2002 Abei ..... F02B 63/02 123/73 C
2003/0029663 A1 2/2003 Etou
2003/0236611 A1 12/2003 James et al.
2005/0039722 A1 2/2005 Montgomery et al.
2006/0175107 A1 8/2006 Etou
2006/0185632 A1 * 8/2006 Mavinahally ..... F02B 25/00 123/73 V
2007/0062188 A1 3/2007 Fry et al.
2007/0113829 A1 * 5/2007 Allen ..... F02M 63/0026 123/492
2007/0234997 A1 10/2007 Prenger
2007/0289302 A1 12/2007 Funke et al.
2008/0060617 A1 * 3/2008 Adachi ..... F02D 41/009 123/456
2008/0250786 A1 10/2008 Robinson
2008/0264380 A1 10/2008 Kang et al.
2008/0276906 A1 * 11/2008 Thomas ..... F02D 41/2438 123/457
2009/0276141 A1 * 11/2009 Surnilla ..... F02D 41/3082 123/457
2010/0024786 A1 2/2010 Robinson
2010/0036585 A1 * 2/2010 Scharfenberg ..... F02M 37/0029 123/456
2010/0041287 A1 2/2010 Woods et al.
2010/0114454 A1 5/2010 French et al.
2010/0213000 A1 8/2010 Inoue
2010/0243343 A1 9/2010 Rasmussen
2010/0313418 A1 12/2010 St. Mary
2011/0061637 A1 * 3/2011 Mavinahally ..... F02B 25/22 123/472

(56) References Cited

U.S. PATENT DOCUMENTS

| | | | | |
|---|---|---|---|---|
| 2011/0093182 | A1 | 4/2011 | Weber et al. | |
| 2011/0186013 | A1* | 8/2011 | Sasaki | F02D 41/0025 123/445 |
| 2011/0296835 | A1 | 12/2011 | Ebisu | |
| 2012/0018468 | A1 | 1/2012 | Dunican, Sr. | |
| 2012/0060494 | A1 | 3/2012 | Sato et al. | |
| 2012/0181468 | A1 | 7/2012 | Telep et al. | |
| 2012/0255379 | A1 | 10/2012 | Lim et al. | |
| 2012/0269620 | A1 | 10/2012 | Boening et al. | |
| 2012/0282078 | A1 | 11/2012 | Marsal et al. | |
| 2012/0285177 | A1 | 11/2012 | Swenson et al. | |
| 2012/0285427 | A1 | 11/2012 | Hayman et al. | |
| 2012/0316756 | A1 | 12/2012 | Tsuyuki | |
| 2013/0111900 | A1 | 5/2013 | Hagner et al. | |
| 2014/0158089 | A1 | 6/2014 | Glugla et al. | |
| 2014/0360178 | A1 | 12/2014 | Wang | |
| 2014/0366815 | A1 | 12/2014 | Lu | |
| 2015/0167593 | A1 | 6/2015 | Kim et al. | |
| 2015/0240707 | A1 | 8/2015 | Wang et al. | |
| 2016/0010541 | A1 | 1/2016 | Wang et al. | |
| 2016/0040566 | A1 | 2/2016 | Barole et al. | |
| 2016/0061139 | A1* | 3/2016 | Imai | F02D 41/3005 123/294 |
| 2016/0341116 | A1 | 11/2016 | French | |
| 2017/0016407 | A1 | 1/2017 | Whitney et al. | |
| 2017/0022927 | A1* | 1/2017 | Sanborn | F02M 59/20 |
| 2017/0051684 | A1 | 2/2017 | Lahti et al. | |
| 2017/0058760 | A1 | 3/2017 | Shor | |
| 2017/0152794 | A1 | 6/2017 | Patil et al. | |
| 2017/0276067 | A1 | 9/2017 | Hand, III et al. | |
| 2017/0292631 | A1 | 10/2017 | Muraoka | |
| 2018/0003103 | A1 | 1/2018 | Kawamura et al. | |
| 2018/0051622 | A1 | 2/2018 | Liu et al. | |
| 2018/0283270 | A1 | 10/2018 | Niwa | |
| 2018/0347455 | A1 | 12/2018 | Noda et al. | |
| 2019/0055862 | A1 | 2/2019 | Fuhrman et al. | |
| 2019/0063304 | A1 | 2/2019 | Lefebvre et al. | |
| 2019/0136754 | A1 | 5/2019 | Brin et al. | |
| 2019/0136818 | A1* | 5/2019 | Blake | B62M 27/02 |
| 2019/0178197 | A1* | 6/2019 | Okamura | F02D 41/3845 |
| 2019/0323510 | A1 | 10/2019 | Serbes | |
| 2020/0182139 | A1 | 6/2020 | Buchwitz et al. | |
| 2021/0040907 | A1 | 2/2021 | Christensen et al. | |
| 2021/0078674 | A1 | 3/2021 | Schuehmacher et al. | |
| 2021/0131366 | A1 | 5/2021 | Blake et al. | |

FOREIGN PATENT DOCUMENTS

| | | | |
|---|---|---|---|
| JP | H05180056 | A | 7/1993 |
| JP | 2000248920 | A | 9/2000 |
| JP | 2002276383 | A | 9/2002 |
| JP | 2008223626 | A | 9/2008 |
| JP | 4661612 | B2 | 3/2011 |
| JP | 5001918 | B2 | 8/2012 |
| KR | 20010059144 | A | 7/2001 |
| RU | 2706329 | C1 | 11/2019 |
| SE | 535726 | C2 | 11/2012 |

OTHER PUBLICATIONS

Office Action dated Mar. 9, 2021 in counterpart Canadian App. No. 3,063, 162.

Office Action issued in corresponding Canadian Application No. 3,063,162 dated Aug. 20, 2021 (4 pages).

Office Action issued in corresponding Canadian Application No. 3,063,162 dated Sep. 16, 2021 (6 pages).

Office Action issued in corresponding Canadian Application No. 3,063,164 dated Feb. 14, 2022.

Canadian Office Action dated Apr. 6, 2022 in corresponding Canadian Application No. 3,063,132 (5 pages).

Canadian Office Action dated Nov. 17, 2022 in corresponding Canadian Application No. 3,105,244.

* cited by examiner

METHOD AND SYSTEM FOR CONTROLLING A TWO STROKE ENGINE BASED ON FUEL PRESSURE

CROSS-REFERENCE TO RELATED APPLICATIONS

This application is a divisional of U.S. application Ser. No. 16/696,198, filed Nov. 26, 2019, which claims priority to U.S. Provisional Application No. 62/776,579, filed on Dec. 7, 2018. The entire disclosure(s) of (each of) the above application(s) is (are) incorporated herein by reference.

FIELD

The present disclosure relates to a vehicle engine and, more particularly, to a method and system for predicting trapped air mass in a two-stroke engine.

BACKGROUND

This section provides background information related to the present disclosure which is not necessarily prior art.

A vehicle, such as a snowmobile, generally includes an engine assembly. The engine assembly is operated with the use of fuel to generate power to drive the vehicle. The power to drive a snowmobile is generally generated by a combustion engine that drives pistons and a connected crank shaft. Two-stroke snowmobile engines are highly tuned, and high specific power output engines that operate under a wide variety of conditions.

Traditional two-stroke calibrations are done open loop because there is no reliable way to measure mass airflow that is trapped in the combustion chamber due to the 'stuffing' effect of a highly tuned exhaust. Without a feedback loop, calibrations are done with an estimation of trapped airflow based on some known parameters. The estimated trapped airflow is used to calculate a required pulse width to supply the desired amount of fuel to the engine. Due to the open loop nature of this calibration, the fueling accuracy is heavily based on the individual engine and the tolerance stack-up of those components that comprise that engine, as well as environmental factors that may alter actual mass airflow through the system.

SUMMARY

This section provides a general summary of the disclosures, and is not a comprehensive disclosure of its full scope or all of its features.

The present closed-loop calibration method allows for more precise fueling on an engine-by-engine basis. The method allows improved emissions, compensation for engine deterioration over engine life (DF factor), improved fuel economy, 'centering' the calibration to avoid the rich and lean instability limits, and compensation for variances in engine air path components.

In a first aspect of the disclosure, a method of controlling a two-stroke engine includes determining a barometric pressure, determining air intake temperature, determining an engine speed, determining a trapped air mass estimation based on barometric pressure, intake temperature, exhaust manifold pressure, tuned pipe pressure and engine speed generating a fuel pulsewidth in response to the trapped air mass estimation.

In another aspect of the disclosure, a method of operating a two-stroke engine includes determining a beginning time of a window for measuring fuel pressure, determining an ending time of the window, measuring fuel pressure between the beginning time and the ending time, determining a fuel pulsewidth based on the fuel pressure and injecting fuel into the two-stroke engine in response to the pulsewidth.

In yet another aspect of the disclosure, a system includes a barometric pressure sensor generating a barometric pressure signal, a tuned pipe temperature sensor generating a tuned pipe temperature signal, an exhaust manifold pressure sensor generating an exhaust manifold pressure signal, a tuned pipe pressure sensor generating a tuned pipe pressure signal, an engine speed sensor generating an engine speed signal, an intake air temperature sensor generating an intake air temperature signal, a two-stroke engine, a fuel system comprising a fuel pressure sensor, a fuel temperature sensor, a fuel injector and a controller in communication with the fuel pressure sensor and fuel temperature sensor. The controller controls the fuel injector with a fuel pulsewidth determined by determining a trapped air mass estimation in response to the barometric pressure signal, the tuned pipe temperature signal, the tuned pipe pressure signal, the exhaust manifold pressure signal, the engine speed signal and the intake air temperature signal.

In yet another aspect of the disclosure, a system comprises a two-stroke engine, a fuel system comprising a fuel pressure sensor, a fuel temperature sensor and a fuel injector, a controller in communication with the fuel pressure sensor and fuel temperature sensor. The controller controls the fuel injector with a fuel pulsewidth determined by determining a beginning time of a window for measuring fuel pressure, determining an ending time of the window, measuring fuel pressure between the beginning time and the ending time, determining a fuel pulsewidth based on the fuel pressure and fuel temperature and commanding the injector to inject fuel into the two-stroke engine in response to a desired fuel mass.

Further areas of applicability will become apparent from the description provided herein. The description and specific examples in this summary are intended for purposes of illustration only and are not intended to limit the scope of the present disclosure.

DETAILED DESCRIPTION

Examples will now be described more fully with reference to the accompanying drawings. Although the following description includes several examples of a snowmobile application, it is understood that the features herein may be applied to any appropriate vehicle, such as motorcycles, all-terrain vehicles, utility vehicles, moped, scooters, etc.

The examples disclosed below are not intended to be exhaustive or to limit the disclosure to the precise forms disclosed in the following detailed description. Rather, the examples are chosen and described so that others skilled in the art may utilize their teachings.

Figure 1:
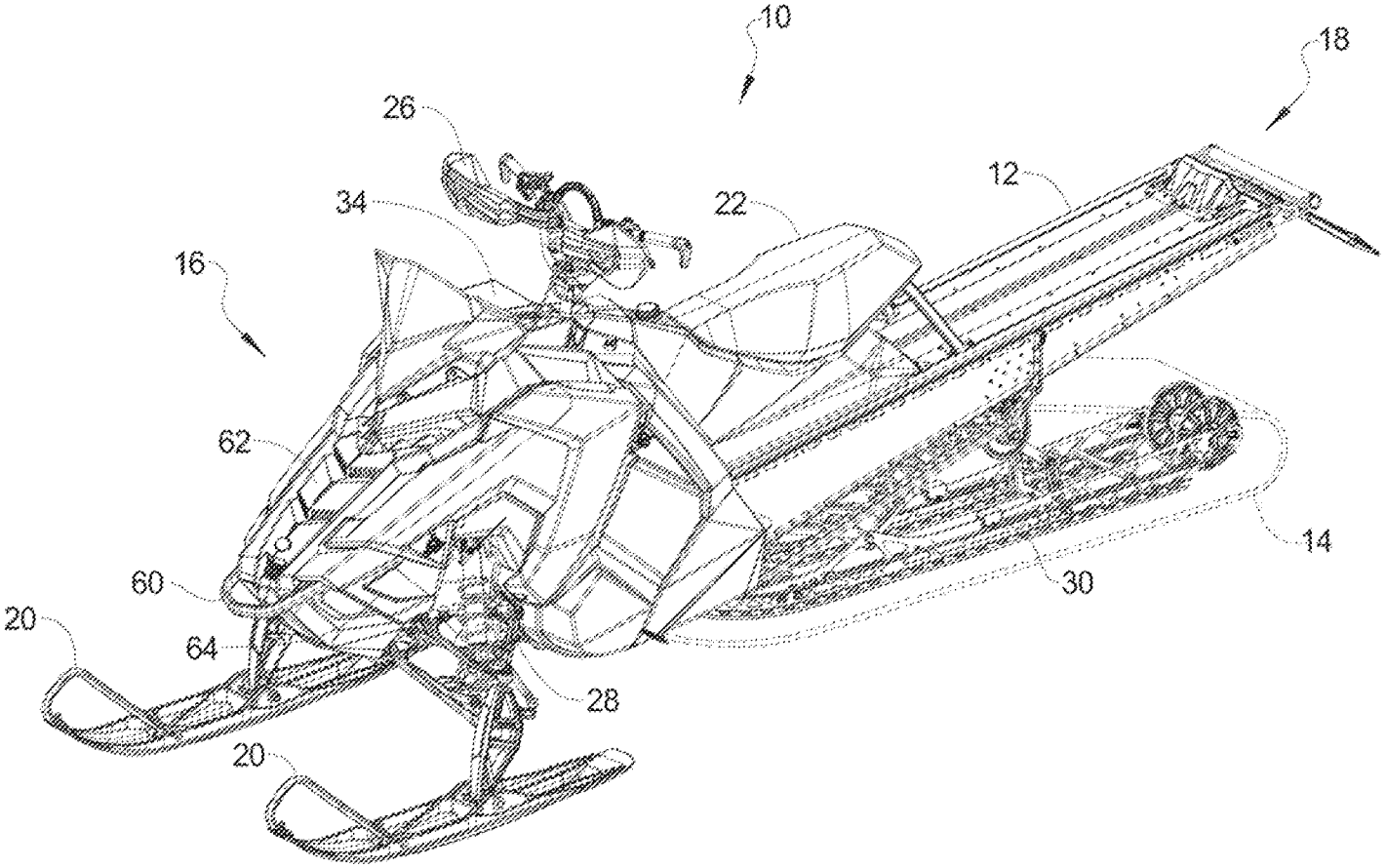
FIG. 1 is a perspective view of a snowmobile.
Figure 2:
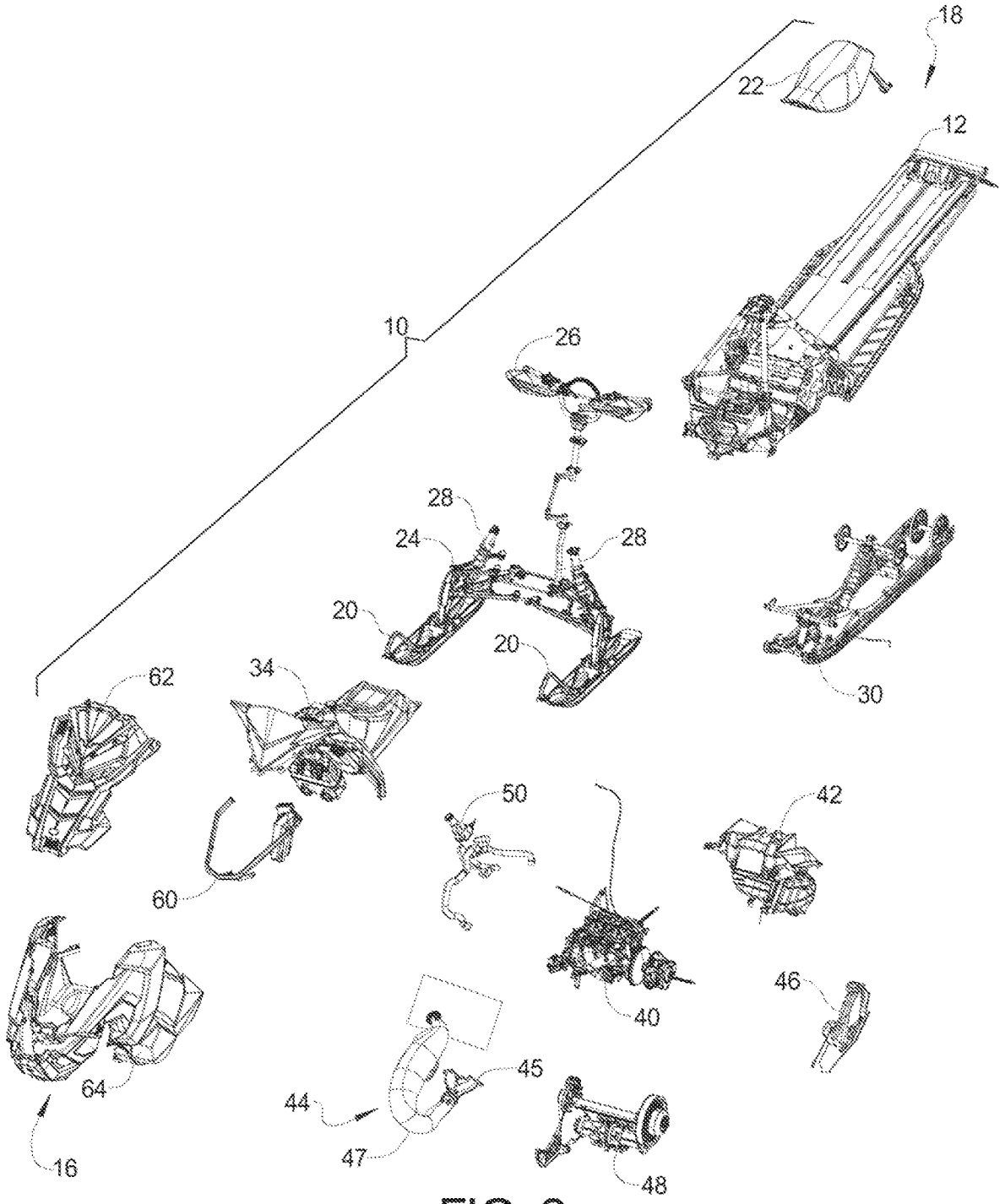
FIG. 2 is an exploded view of the snowmobile of FIG. 1.
Figure 2A:
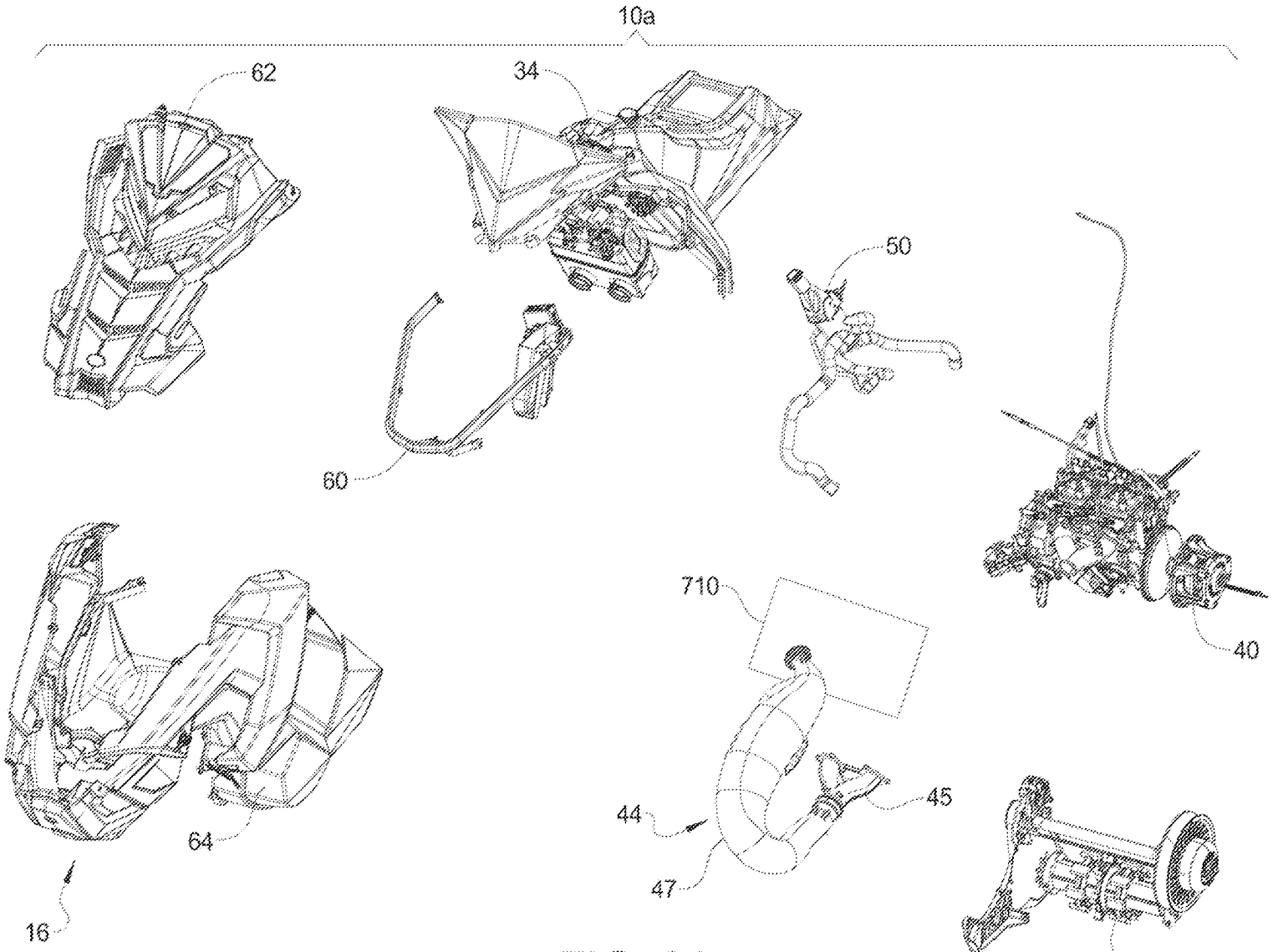
FIGS. 2A and 2B are enlarged exploded views of FIG. 2.
Figure 2B:
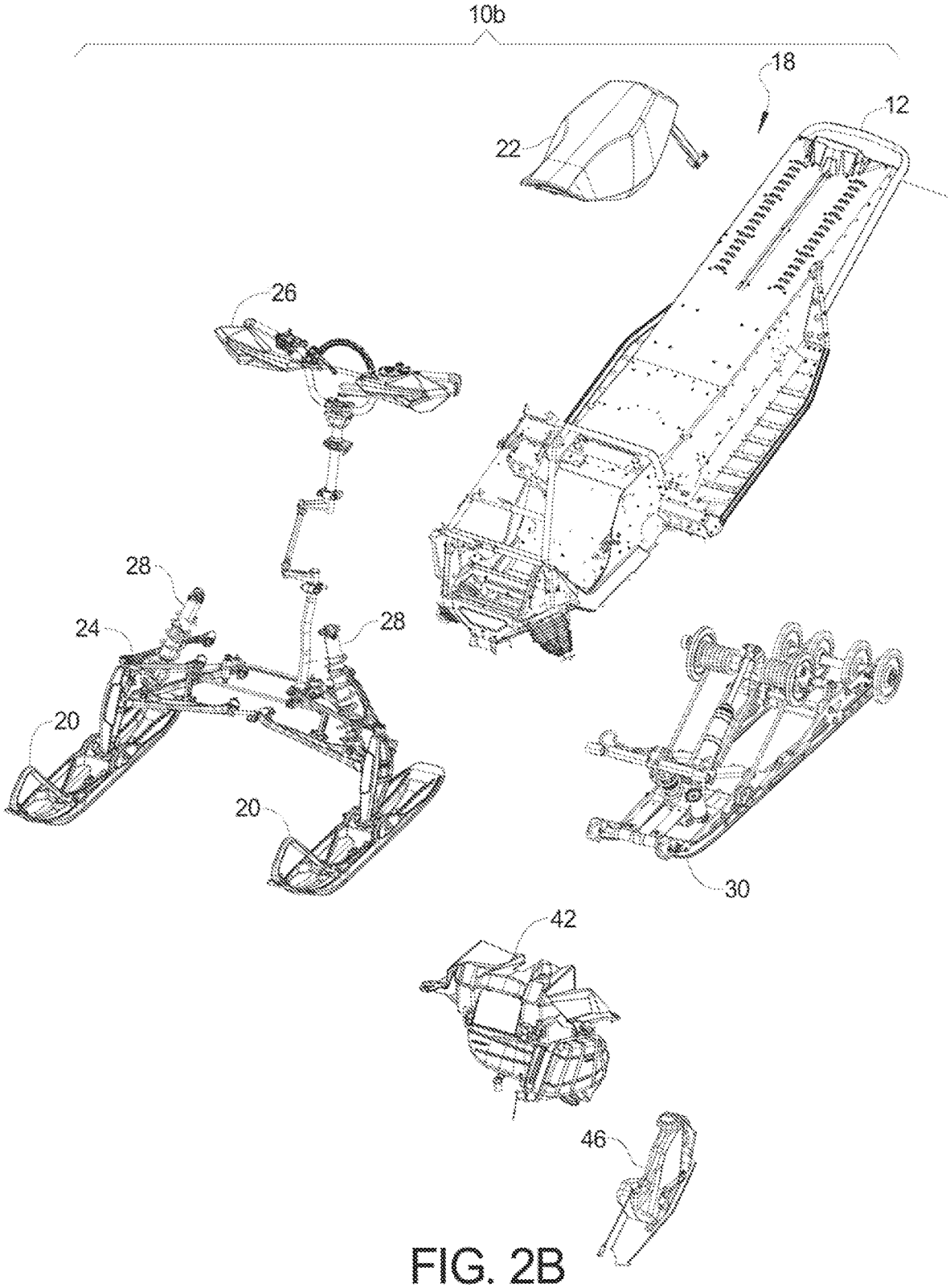

Referring now to FIGS. 1 and 2, one example of an exemplary snowmobile 10 is shown. Snowmobile 10 includes a chassis 12, an endless belt assembly 14, and a pair of front skis 20. Snowmobile 10 also includes a front-end 16 and a rear-end 18.

The snowmobile 10 also includes a seat assembly 22 that is coupled to the chassis assembly 12. A front suspension assembly 24 is also coupled to the chassis assembly 12. The front suspension assembly 24 may include handlebars 26 for steering, shock absorbers 28 and the skis 20. A rear suspension assembly 30 is also coupled to the chassis assembly 12. The rear suspension assembly 30 may be used to support the endless belt 14 for propelling the vehicle. An electrical console assembly 34 is also coupled to the chassis assembly 12. The electrical console assembly 34 may include various components for displaying engine conditions (i.e., gauges) and for electrically controlling the snowmobile 10.

The snowmobile 10 also includes an engine assembly 40. The engine assembly 40 is coupled to an intake assembly 42 and an exhaust assembly 44. The intake assembly 42 is used for providing fuel and air into the engine assembly 40 for the combustion process. Exhaust gas leaves the engine assembly 40 through the exhaust assembly 44. The exhaust assembly 44 includes the exhaust manifold 45 and tuned pipe 47. An oil tank assembly 46 is used for providing oil to the engine for lubrication where it is mixed directly with fuel. In other systems oil and fuel may be mixed in the intake assembly. A drivetrain assembly 48 is used for converting the rotating crankshaft assembly from the engine assembly 40 into a potential force to use the endless belt 14 and thus the snowmobile 10. The engine assembly 40 is also coupled to a cooling assembly 50.

The chassis assembly 12 may also include a bumper assembly 60, a hood assembly 62 and a nose pan assembly 64. The hood assembly 62 is movable to allow access to the engine assembly 40 and its associated components.

Figure 3:
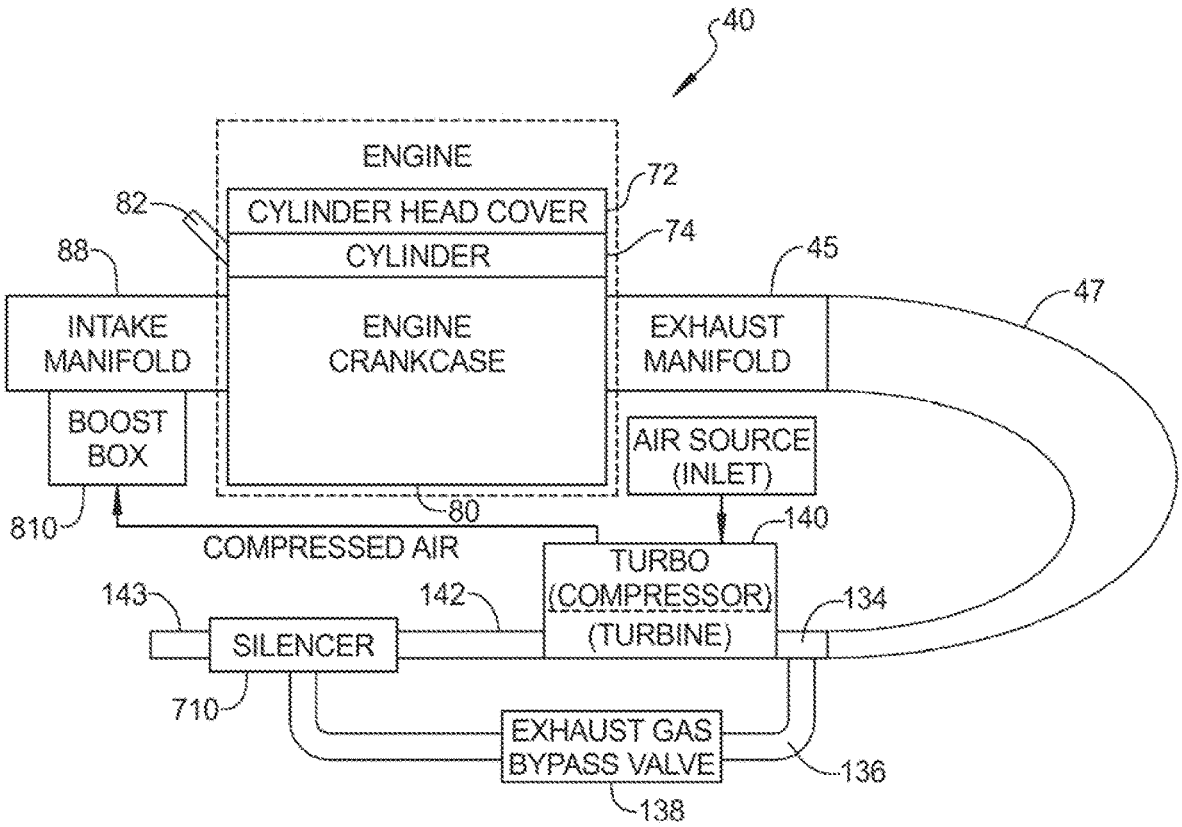
FIG. 3 is a block diagram of the engine of FIG. 3.
Figure 4:
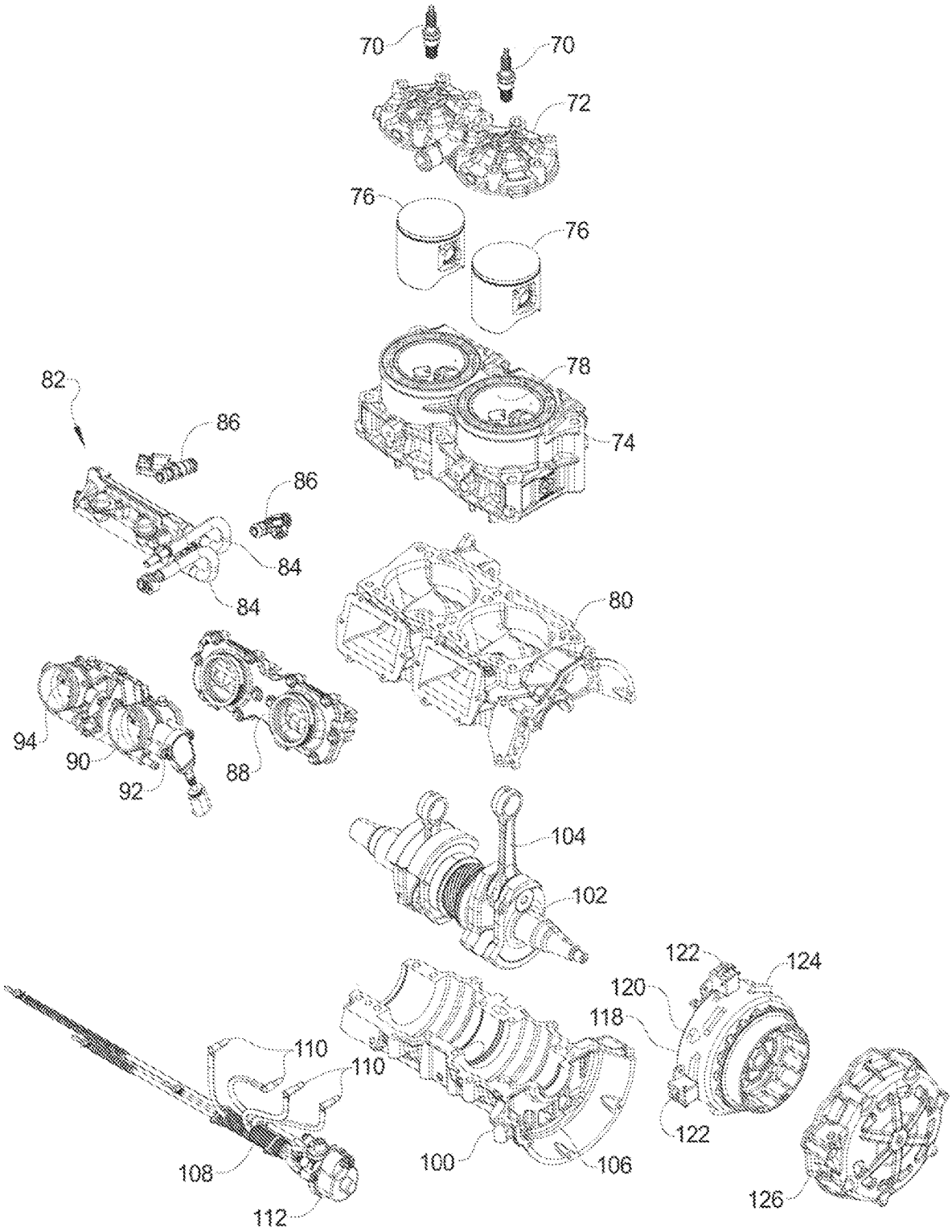
FIG. 4 is an exploded view of the engine of FIG. 3.

Referring now to FIGS. 3 and 4, the engine assembly 40 is illustrated in further detail. The engine assembly 40 is a two-stroke engine that includes the exhaust assembly 44 that includes an exhaust manifold 45, tuned pipe 47 and exhaust silencer 710.

The engine assembly 40 may include spark plugs 70 which are coupled to a one-piece cylinder head cover 72. The cylinder head cover 72 is coupled to the cylinder 74 with twelve bolts which is used for housing the pistons 76 to form a combustion chamber 78 therein. The cylinder 74 is mounted to the engine upper crankcase 80.

The fuel system 82 that forms part of the engine assembly 40, includes fuel lines 84 and fuel injectors 86. The fuel lines 84 provide fuel to the fuel injectors 86 which inject fuel, in this case, into a port in the cylinder adjacent to the pistons 76. In other cases, an injection may take place adjacent to the piston, into a boost box (detailed below) or into the throttle body. An intake manifold 88 is coupled to the engine upper crankcase 80. The intake manifold 88 is in fluidic communication with the throttle body 90. Air for the combustion processes is admitted into the engine through the throttle body 90 which may be controlled directly through the use of an accelerator pedal or hand operated lever or switch. A throttle position sensor 92 is coupled to the throttle to provide a throttle position signal corresponding to the position of the throttle plate 94 to an engine controller discussed further herein.

The engine upper crankcase 80 is coupled to lower crankcase 100 and forms a cavity for housing the crankshaft 102. The crankshaft 102 has connecting rods 104 which are ultimately coupled to the pistons 76. The movement of the pistons 76 within the combustion chamber 78 causes a rotational movement at the crankshaft 102 by way of the connecting rods 104. The crankcase may have openings or vents 106 therethrough.

The system is lubricated using oil lines 108 which are coupled to the oil injectors 110 and an oil pump 112.

The crankshaft 102 is coupled to a generator flywheel 118 and having a stator 120 therein. The flywheel 118 has crankshaft position sensors 122 that aid in determining the positioning of the crankshaft 102. The crankshaft position sensors 122 are aligned with the teeth 124 and are used when starting the engine, as well as being used to time the operation of the injection of fuel during the combustion process. A stator cover 126 covers the stator 120 and flywheel 118.

Discussed below are various features of the engine assembly 40 used in the snowmobile 10. Each of the features relate to the noted section headings set forth below. It should be noted that each of these features can be employed either individually or in any combination with the engine assembly 40. Moreover, the features discussed below will utilize the reference numerals identified above, when appropriate, or other corresponding reference numerals as needed. Again, as noted above, while the engine assembly 40 is a two-stroke engine that can be used with the snowmobile 10, the engine assembly 40 can be used with any appropriate vehicles and the features discussed below may be applied to four-stroke engine assemblies as well.

The engine assembly 40 also includes an exhaust manifold 45 that directs the exhaust gases from the engine. The exhaust manifold 45 is in fluid communication with a tuned pipe 47. The tuned pipe 47 is specifically shaped to improve the performance and provide the desired feedback to the engine assembly 40. The tuned pipe 47 is in communication with a stinger 134. The tuned pipe 47 has a bypass pipe 136 coupled thereto. The bypass pipe 136 has an exhaust gas bypass valve 138 used for bypassing some or all of the exhaust gases from being directed to a turbocharger 140. Details of the turbocharger 140 are set forth in the following figures.

Figure 5:
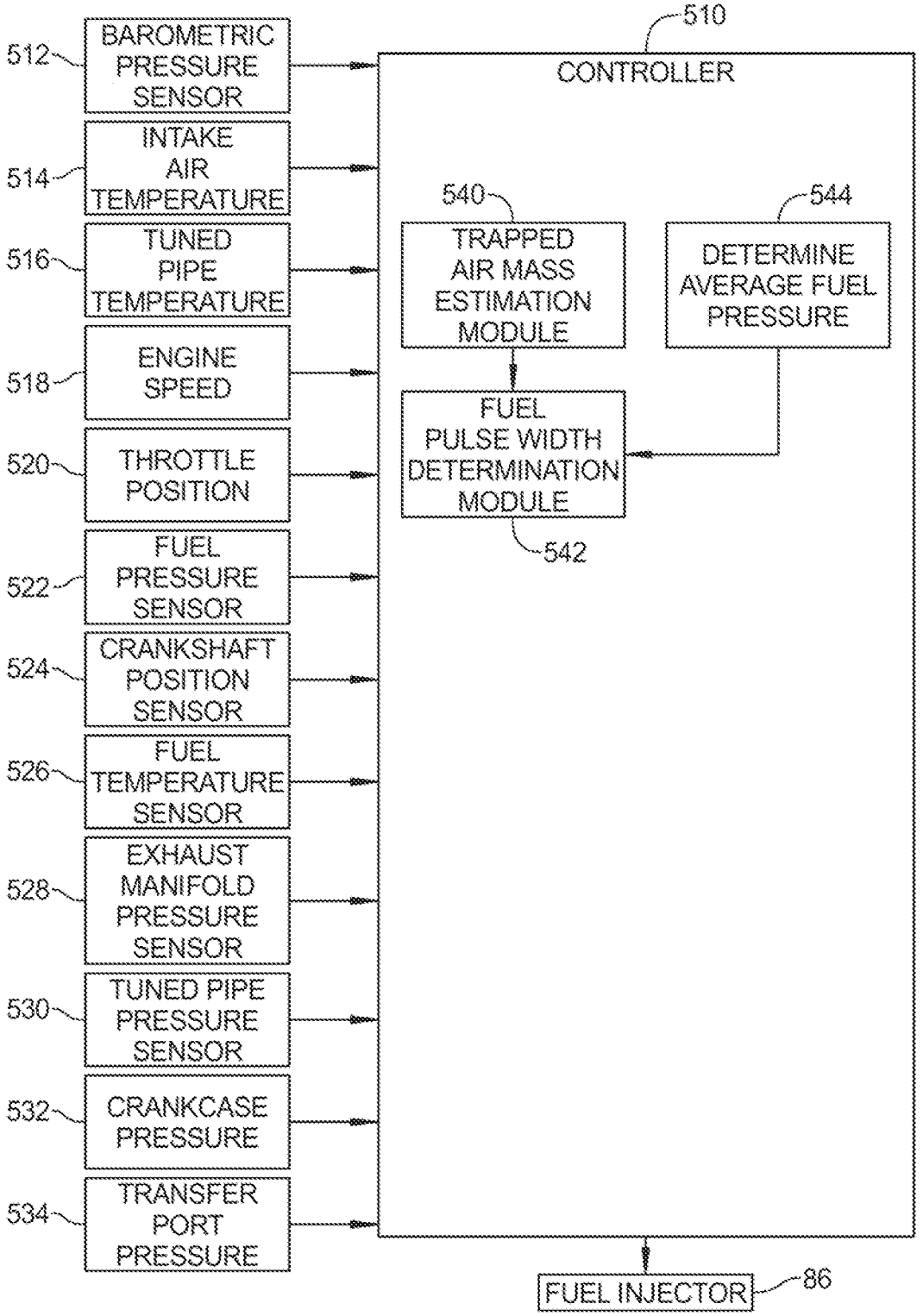
FIG. 5 is a block diagrammatic view of a system for controlling a fuel pulsewidth based upon an estimated trapped air mass.

Referring now to FIG. 5, a method for controlling the engine assembly 40. Although the engine set forth herein is disclosed as a two-stroke, the teachings set forth herein apply to four-stroke engines as well. A controller 510 is in communication with a plurality of sensors. The plurality of sensors may include a barometric pressure sensor 512, an intake air temperature sensor 514, a tuned pipe temperature 516, an engine speed sensor 518, a throttle position sensor 520, a fuel pressure sensor 522, an exhaust manifold pressure sensor 528, a tuned pipe pressure sensor 530 a crankcase pressure sensor 532 and a transfer port pressure sensor 534. Each sensor generates a respective electrical signal corresponding to the measured parameter. For example, the barometric pressure sensor generates a barometric pressure signal corresponding to the barometric pressure. Barometric pressure sensor 512 may also be an indication of the elevation of the vehicle. The intake air temperature sensor 514 generates an intake air temperature signal corresponding to the intake air temperature of the vehicle. The tuned pipe temperature sensor 516 generates a temperature signal corresponding to the temperature of the exhaust gases within the tuned pipe. The engine speed sensor 518 generates an engine speed signal corresponding to the rotational speed of the engine. The throttle position sensor 520 generates a throttle position signal corresponding to the position of the throttle of the vehicle. A fuel pressure sensor 522 generates a fuel pressure signal corresponding to the pressure of fuel being injected. A crankshaft position sensor 524 generates a crankshaft position signal corresponding to the position of the crankshaft. A fuel temperature sensor 526 generate a fuel temperature signal corresponding to the temperature of the fuel. The exhaust gas manifold pressure sensor 528 generates an exhaust gas manifold pressure signal corresponding to the manifold pressure. The tuned pipe pressure sensor 530 generates a signal corresponding to the pressure in the tuned pipe. The crankcase pressure sensor 532 generates a crankcase pressure signal corresponding to the pressure within the engine crankcase. The transfer port pressure sensor generates a transfer port pressure signal corresponding to the air/fuel mixture traversing through the transfer port of the engine.

The controller 510 generates a trapped air mass estimation from a trapped air mass estimation module 540. The trapped air mass estimation module 540 may determine or estimate the trapped air mass which ultimately allows a more precise fueling and in particular a more precise fuel pulsewidth determination to control the pulsewidth to the fuel injectors 86. A fuel pulsewidth determination module 542 determines a fuel pulsewidth based upon the trapped air mass estimation module 540. Two-stroke engines are difficult to predict or calculate the trapped air mass. There is no way to measure mass airflow in a combustion chamber of a two-stroke. Therefore, an estimation of the trapped air mass may be determined based upon inputs from the various sensors. In particular, the barometric pressure, the intake air temperature, the tuned pipe temperature, the engine speed, the fuel temperature, the fuel pressure, the exhaust manifold pressure, the tuned pipe pressure, the crankcase pressure, the transfer port pressure and the like may all be used to estimate the trapped air mass so that the required pulsewidth to provide the amount of fuel to the engine is provided. Predicted trapped air mass provides a more accurate method of calculating the necessary injected fuel mass, thereby reducing inconsistencies found in more typical 2-stroke calculation methods.

Figure 6:
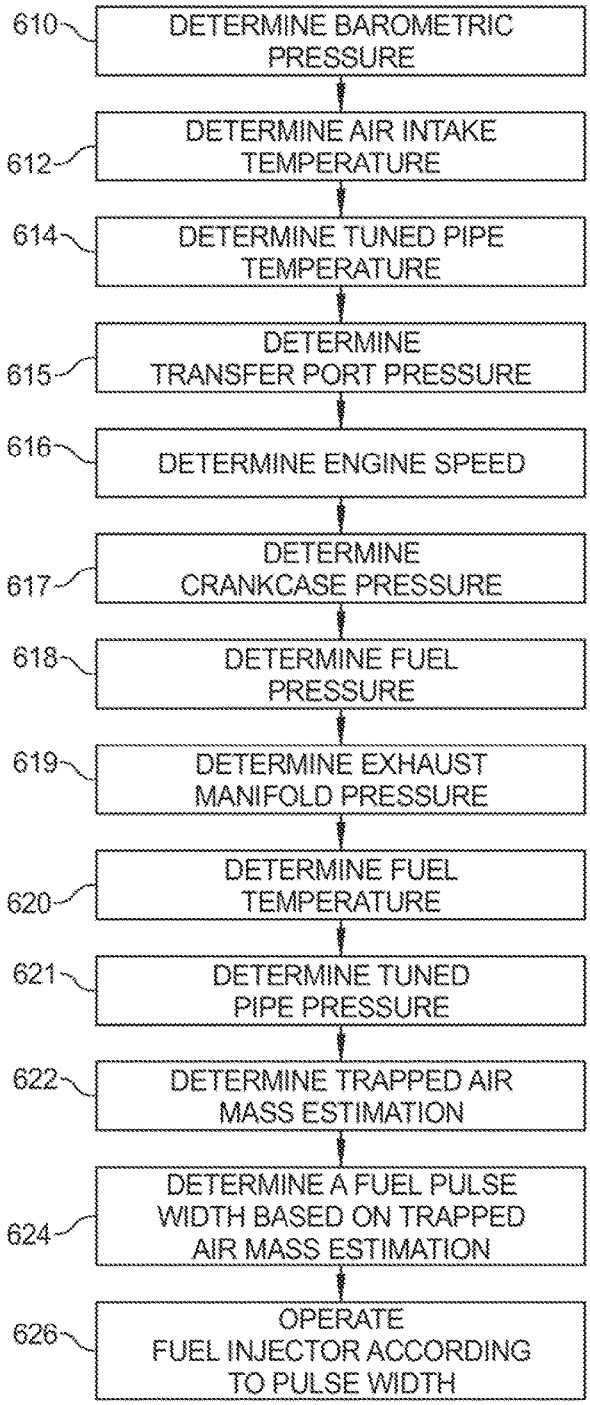
FIG. 6 is a flowchart of a method for controlling an engine based upon trapped air mass.

Referring now to FIG. 6, the method of determining the fuel pulsewidth based upon the trapped air mass estimation is set forth. Again, the methods set forth herein may be applied to two-stroke or four-stroke engines. In step 610 a barometric pressure is determined from the barometric pressure sensor of FIG. 5. In step 612 the air intake temperature corresponding to the intake air of the ambient air around the vehicle is determined. This may be performed by the intake air temperature sensor 514 as illustrated above. In step 614 the tuned pipe temperature which corresponds to the exhaust gas temperature is determined by the tuned pipe temperature sensor 516 illustrated above. In step 615 the transfer port pressure is determined. In step 616 the engine speed of the vehicle is determined. The engine speed corresponds to the rotational speed of the crankshaft of the engine. In step 618 the fuel pressure is determined. In step 619 the manifold pressure is determined. In step 620 the fuel temperature is determined. In step 621 the tuned pipe pressure is determined. In step 622 the trapped air mass is estimated using one or more of the engine speed, the tuned pipe temperature, the air intake temperature, fuel temperature, fuel pressure and the barometric pressure, exhaust manifold pressure, tuned pipe pressure, transfer port pressure, crankshaft pressure and the like.

In step 624 the fuel pulsewidth based upon the trapped air mass is determined. The fuel pulsewidth may be calibrated during the development of the engine to correspond to a particular amount of trapped air mass. In step 626, the fuel injector is thus operated according to the pulsewidth to provide the desired amount of fuel to the engine.

Figure 7:
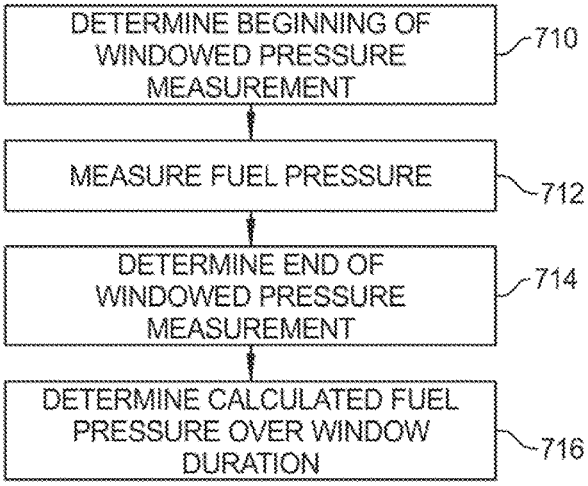
FIG. 7 is a flowchart of a method for measuring fuel pressure within a window.

Referring now to FIG. 7, a method for determining pressure windowing for determining the fuel pressure of the vehicle is set forth. The accuracy is taken into consideration. Pressure windowing is used in FIG. 7 which in step 710 determines the beginning of a windowed pressure measurement and thereafter in step 712 fuel pressure measurements are performed. The fuel pressure measurements are performed before the end of the pressure window as determined in step 714. That is, step 714 determines the end of a windowed pressure measurement. Therefore, the measured fuel pressure is performed at a more accurate position in time relative to the fuel injection event. In step 716 the measured fuel pressures are averaged (in the case of regular samples or integrated over irregular sampling to obtain the calculated fuel pressure during the window).

Figure 8:
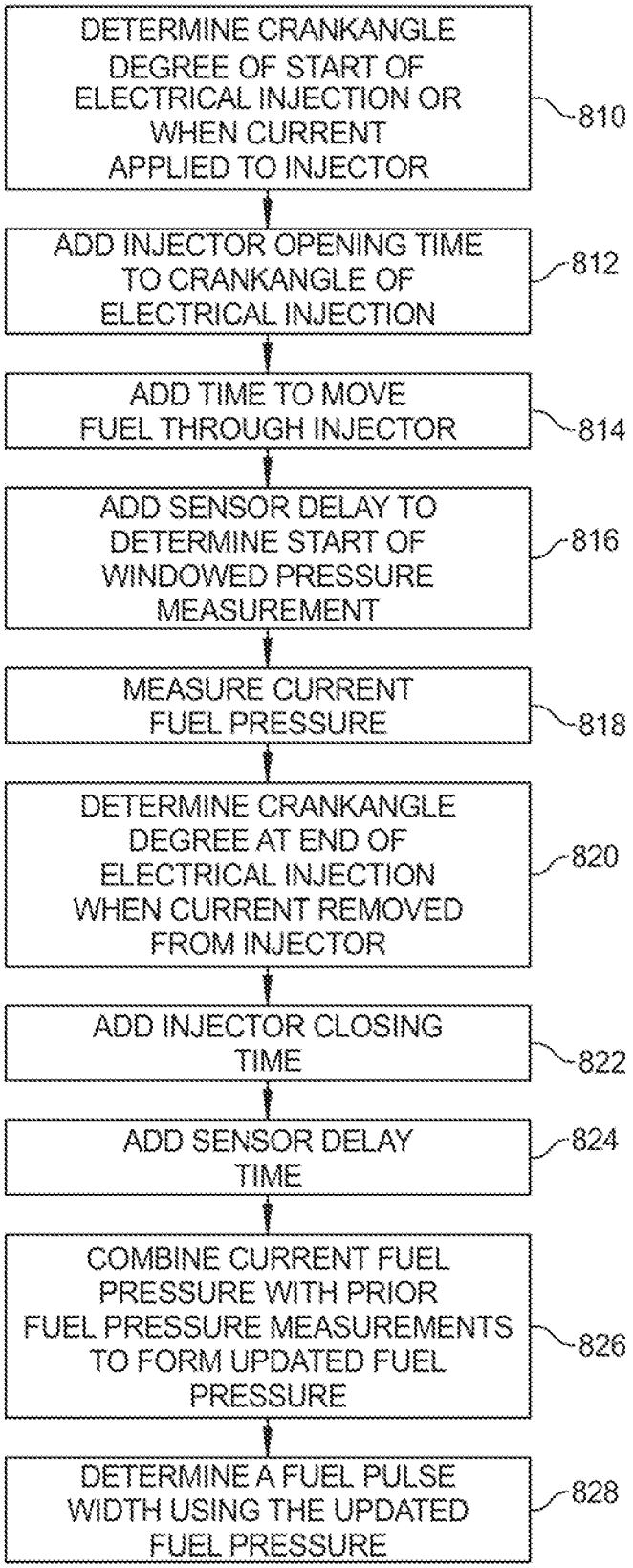
FIG. 8 is a detailed flowchart of a method for measuring fuel pressure within a window.

Referring now to FIG. 8, a more detailed series of steps corresponding to those set forth in FIG. 7 is provided. In FIG. 8 the crank angle of the start of the electrical injection or when the current is applied to the injector is determined in step 810. In step 812 the injector opening time is added to the crank angle. The fuel acceleration time is also added to the crank angle of the electrical injection time, in step 814. The opening time is the mechanical opening time of the injector. The fuel acceleration time is the delay between the mechanical opening of the injector and when fuel actually starts flowing from the injector nozzle. In step 816 the sensor delay is determined and added to the timing measurements of steps 810, 812 and 814. The four factors, the electrical injection time, the mechanical opening time, the fuel acceleration time and the sensor delay, are used to determine the beginning of the pressure measurement window. Three factors, the electrical injection time, mechanical closing time, and the sensor delay are used to determine the end of the pressure measurement window. In step 818 the fuel pressure is measured within the window. The fuel pressure measurement ends at the closing of the window. In step 820 a crank angle degree at the end of the electrical injection or when the current is removed from the injector is determined. The injector closing time is determined in step 822 and the sensor delay time is determined in step 824. Thus, step 818 is performed within the window. That is, step 818 is performed at the beginning or after the opening of the window and before the closing of the window based upon the mechanical, electrical and sensor delay of the system. In step 826 the average or calculated (integrated) current fuel pressure is determined. The pressure measured in step 818 is averaged with prior fuel pressure measurements taken within the same injection event to calculate the average or integrated fuel pressure during the injection event. In step 828 the fuel pulse width using the updated average pressure is determined. Thus, the average or integration calculations may be changed over time and thus the fuel pulse width may be also changed over time.

Figure 9:
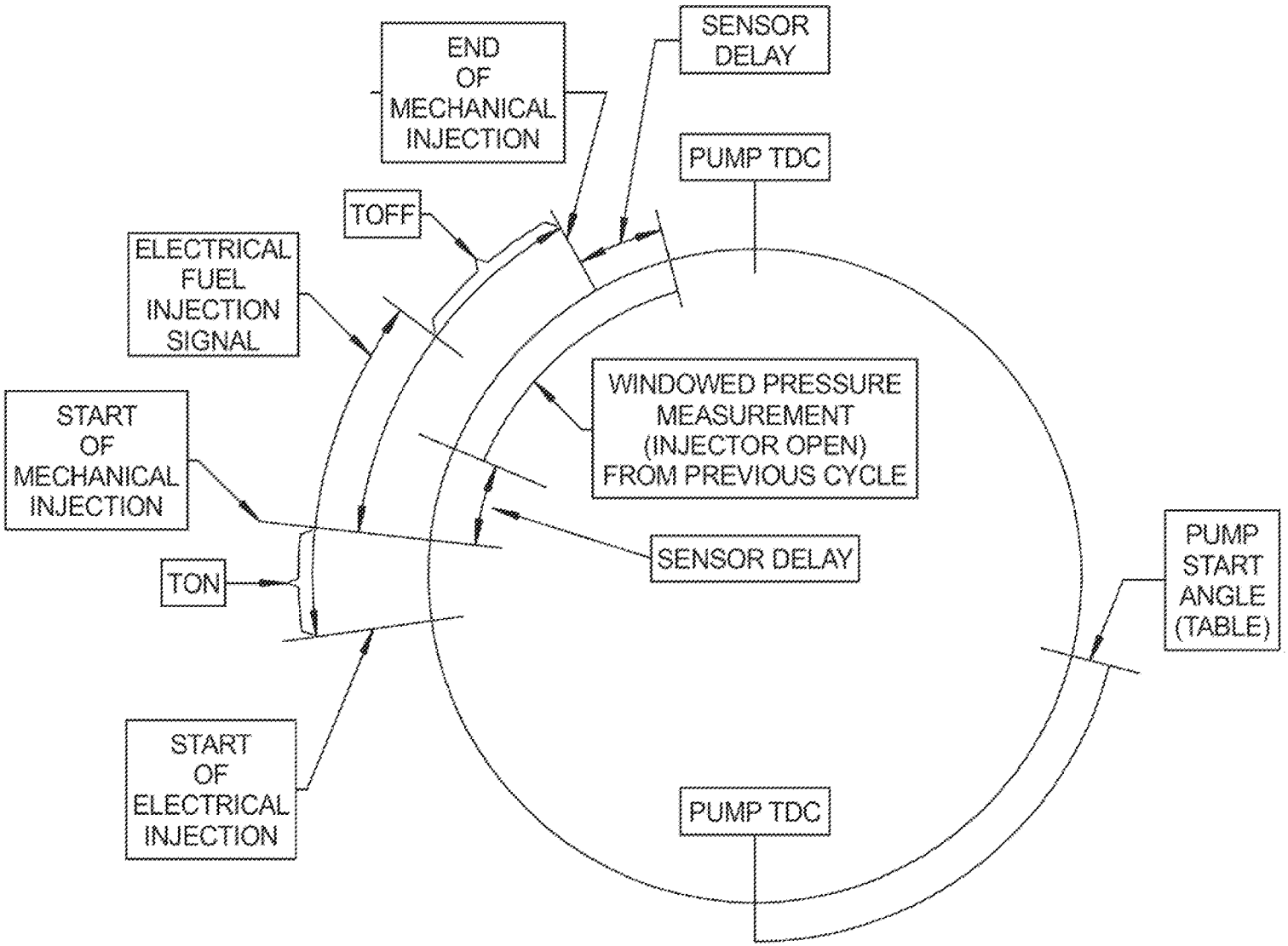
FIG. 9 is a diagrammatic view showing timing of the various events of FIG. 8 with respect to crank angle.

Referring now to FIG. 9, a rotational position of the crankshaft relative to the start of the electrical injection, the start of the mechanical injection, the fuel injector signal, the engine top dead center and the calculated pulse width when the injector is opened from the previous cycles is set forth.

The windowed pressure measurement is always at least one cycle behind since average fuel pressure is determined based upon the previous fuel injection event. As can be seen the sensor delay is also taken in to consideration. The averages (in the case of equivalent sample lengths) or integrations (in the case of inequivalent sample lengths) for the opening of the window and the closing of the window may be performed over time so that the windowed pressure measurement illustrated in FIG. 9 is continually determined. The calculations take into consideration the sensor delay region after which the electrical and mechanical injection have ceased.

Figure 10:
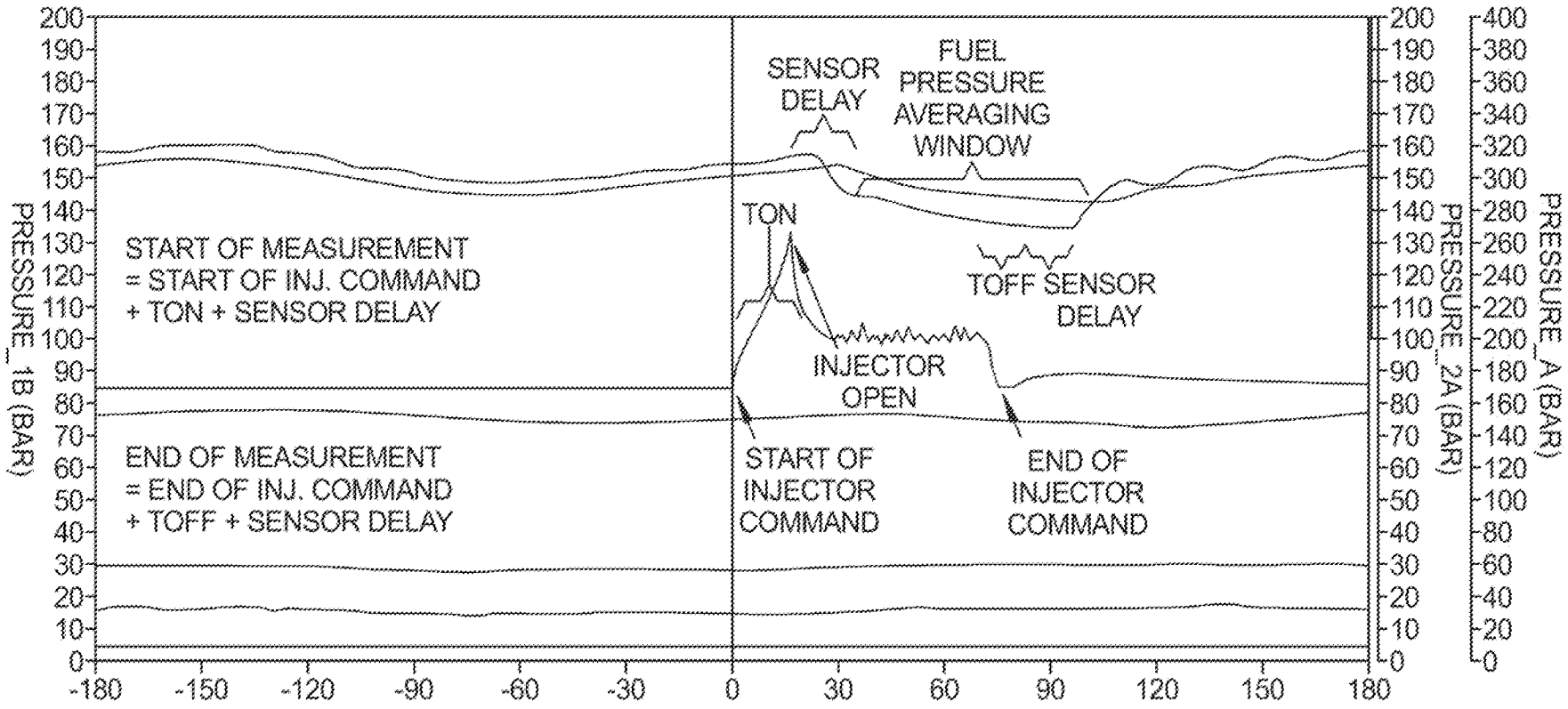
FIG. 10 is a graph of pressure versus crank angle relative to the windows illustrated in FIG. 9.

Referring now to FIG. 10, a diagram illustrating the start of the injector command relative to the mechanical on time Ton, the sensor delay and the average window are set forth. The end of the injector command, the Toff corresponding to the mechanical off time and the sensor delay are all set forth and ultimately correspond to the average window. It should be noted that "0" is the start of injection event and not the top dead center.

Examples are provided so that this disclosure will be thorough, and will fully convey the scope to those who are skilled in the art. Numerous specific details are set forth such as examples of specific components, devices, and methods, to provide a thorough understanding of examples of the present disclosure. It will be apparent to those skilled in the art that specific details need not be employed, that examples may be embodied in many different forms and that neither should be construed to limit the scope of the disclosure. In some examples, well-known processes, well-known device structures, and well-known technologies are not described in detail.

What is claimed is:

1. A method of operating a two-stroke engine comprising:
determining a beginning time of a window for measuring fuel pressure, wherein the beginning time is a function of electrical injection, mechanical injection and sensor delay;
determining an ending time of the window;
measuring fuel pressure between the beginning time and the ending time;
determining a fuel pulsewidth based on the fuel pressure; and
injecting fuel into the two-stroke engine in response to the pulsewidth.

2. The method of claim 1 further comprising averaging fuel pressure from a plurality of cycles to determine an average pulsewidth based on average fuel pressure.

3. A method of operating a two-stroke engine comprising:
determining a beginning time of a window for measuring fuel pressure, wherein determining the beginning time comprises determining a beginning time as a function of a starting of mechanical injection time;
determining an ending time of the window;
measuring fuel pressure between the beginning time and the ending time;
determining a fuel pulsewidth based on the fuel pressure; and
injecting fuel into the two-stroke engine in response to the pulsewidth.

4. The method of claim 3 wherein determining the beginning time comprises adjusting the beginning time as a function of electrical injection time.

5. The method of claim 4 wherein determining the beginning time comprises determining the beginning time as a function of pressure sensor delay time.

6. A method of operating a two-stroke engine comprising:
determining a beginning time of a window for measuring fuel pressure;
determining an ending time of the window, wherein the ending time is a function of electrical injection, mechanical injection and sensor delay;
measuring fuel pressure between the beginning time and the ending time;
determining a fuel pulsewidth based on the fuel pressure; and
injecting fuel into the two-stroke engine in response to the pulsewidth.

7. A method of operating a two-stroke engine comprising:
determining a beginning time of a window for measuring fuel pressure;
determining an ending time of the window, wherein the end time is a function of ending mechanical injection;
measuring fuel pressure between the beginning time and the ending time;
determining a fuel pulsewidth based on the fuel pressure; and
injecting fuel into the two-stroke engine in response to the pulsewidth.

8. A system comprising:
an engine;
a fuel system comprising a fuel pressure sensor, fuel temperature sensor and a fuel injector;
a controller in communication with the fuel pressure sensor, fuel temperature sensor and controlling the fuel injector with a fuel pulsewidth determined by determining a beginning time of a window for measuring fuel pressure, wherein the beginning time is a function of electrical injection, mechanical injection, fuel acceleration time, and sensor delay, determining an ending time of the window, measuring fuel pressure between the beginning time and the ending time, determining a fuel pulsewidth based on the fuel pressure and fuel temperature and injecting fuel into the engine in response to a desired fuel mass.

9. The system of claim 7 wherein the beginning time corresponds to a crank angle at a starting of electrical injection adjusted for mechanical injection.

10. A system comprising:
an engine;
a fuel system comprising a fuel pressure sensor, fuel temperature sensor and a fuel injector;
a controller in communication with the fuel pressure sensor, fuel temperature sensor and controlling the fuel injector with a fuel pulsewidth determined by determining a beginning time of a window for measuring fuel pressure, determining an ending time of the window, wherein the ending time is a function of electrical injection, mechanical injection and sensor delay, measuring fuel pressure between the beginning time and the ending time, determining a fuel pulsewidth based on the fuel pressure and fuel temperature and injecting fuel into the engine in response to a desired fuel mass.

11. The system of claim 7 wherein the ending time corresponds to a crank angle at an ending of electrical injection adjusted for mechanical injection.

* * * * *